US006707286B1

(12) United States Patent
Gregoire, Jr.

(10) Patent No.: US 6,707,286 B1
(45) Date of Patent: Mar. 16, 2004

(54) LOW VOLTAGE ENHANCED OUTPUT IMPEDANCE CURRENT MIRROR

(75) Inventor: Bernard Robert Gregoire, Jr., Bozeman, MT (US)

(73) Assignee: AMI Semiconductor, Inc., Pocatello, ID (US)

( * ) Notice: Subject to any disclaimer, the term of this patent is extended or adjusted under 35 U.S.C. 154(b) by 0 days.

(21) Appl. No.: 10/373,912

(22) Filed: Feb. 24, 2003

(51) Int. Cl.[7] ..... G05F 3/16; G05F 3/20
(52) U.S. Cl. ..... 323/316; 327/543
(58) Field of Search ..... 323/316, 315, 323/313, 314; 327/543

(56) References Cited

U.S. PATENT DOCUMENTS

| | | | | | |
|---|---|---|---|---|---|
| 4,882,548 | A | | 11/1989 | Marrah et al. | 330/288 |
| 5,451,909 | A | | 9/1995 | Fattaruso | 330/311 |
| 5,625,313 | A | | 4/1997 | Etoh | 327/486 |
| 5,892,356 | A | | 4/1999 | Chuang | 323/315 |
| 6,016,051 | A | * | 1/2000 | Can | 323/315 |
| 6,018,235 | A | * | 1/2000 | Mikuni | 323/313 |
| 6,020,731 | A | * | 2/2000 | Shinohara | 323/316 |
| 6,172,495 | B1 | * | 1/2001 | Washburn | 323/316 |
| 6,388,508 | B1 | * | 5/2002 | Kawasumi | 327/543 |
| 6,529,066 | B1 | * | 3/2003 | Guenot et al. | 327/539 |
| 6,570,371 | B1 | * | 5/2003 | Volk | 323/315 |

OTHER PUBLICATIONS

"Analog Integrated Circuit Design"; David A. Johns & JKen Martin pp. 260 to 265.

"A High–Swing, High–Impedance MOS Cascode Circuit"; Eduard Sackinger, Walter Guggenbuhl 1990 IEEE IEEE Journal of Solid–State Circuits, vol. 25, No. 1, Feb. 1990.

"A Fast–Settling CMOS OP AMP For SC Circuits With 90–DB DC Gain"; Klaas Bult & Govert J.G.M. Geelen, IEEE Journal Of Solid–State Circuits, vol. 25, No. 6, Dec. 1990 1990 IEEE pp. 1379–1384.

"A Novel CMOS Linear Transconductance Cell For Continous–Time Filters"; Umberto Gatti, Franco Maloberti, Guido Torelli; Department of Electronics, University of Pavia, Via Abbiategrasso, 209–27100 Pavia–Italy; 1990 IEEE; pp. 1173–1176.

* cited by examiner

*Primary Examiner*—Bao Q. Vu
(74) *Attorney, Agent, or Firm*—Workman Nydegger

(57) ABSTRACT

An enhanced output impedance current mirror in which the operational amplifier includes a set of four MOSFETs having a common gate that is connected to a drain terminal of one of the differential pairs. Two of the MOSFETs reside in parallel in the current path of each of the MOSFETs of the differential pair. The differential pair MOSFET that has its drain terminal connected to the common gate also has a gate terminal that is connected to the common node between the two other MOSFETs in its current path.

13 Claims, 5 Drawing Sheets

LOW VOLTAGE ENHANCED OUTPUT IMPEDANCE CURRENT MIRROR

BACKGROUND OF THE INVENTION

1. The Field of the Invention

The present invention relates to analog integrated circuit design, and more particularly, to low voltage, enhanced output impedance current mirrors.

2. Background and Related Art

Computing technology has revolutionized the way people work and play and has contributed enormously to the advancement of humankind. Computing technology is largely enabled by various integrated circuit designs. In many analog circuit designs, it is often desirable to mirror a current from one portion of the circuit to another. While there are various types of current mirrors, FIG. 1 illustrates a specialized conventional current mirror that mirrors an input current $I_{IN}$ from one branch in the circuit to another branch of the circuit in the form of $I_{OUT}$.

The current mirroring is enabled by connecting the gates of both n-type Metal-Oxide Semiconductor Field Effect Transistors (hereafter also referred to as an "nMOSFET") m and ml to each other and to the drain terminal of nMOSFET m. It is well known to those of ordinary skill in the art that the configuration of nMOSFET m2 with the Operational Amplifier AMP and with the rest of the circuitry as shown in FIG. 1 results in a current mirror often referred to as an "enhanced output impedance current mirror" since the use of the amplifier significantly increases output impedance $R_{OUT}$ as compared to a basic cascoded current mirror. The circuit is also known as a "regulated cascode current source" since gain is used to enhance the output impendence of the current source. Specifically, the output impedance $R_{OUT}$ of the illustrated current mirror is defined by the following equation (1):

$$R_{OUT}=(r_{dsl})\times(g_{m2}\times r_{ds2})\times(A+1) \quad (1)$$

where $r_{dsl}$ is the drain-source resistance of the nMOSFET m1, $g_{m2}$ is the transconductance of nMOSFET m2, $r_{ds2}$ is the drain-source resistance of the nMOSFET m2, and A is the open-loop gain of the amplifier AMP. A traditional cascode current mirror would have an output impedance according to the following equation (2):

$$R_{OUT}=(r_{dsl})\times(g_{m2}\times r_{ds2}) \quad (2)$$

Accordingly, the enhanced output impedance current mirror increases output impedance by a factor of (A+1).

It is advantageous for the output impedance of the enhanced output impedance current mirror to remain large for small values of $V_{OUT}$. As $V_{OUT}$ is decreased, the output impedance will remain close to its nominal value until nMOSFET m2 enters the linear region when the drain-to-source voltage $V_{ds2}$ of nMOSFET m2 decreases to the saturation voltage $V_{dsat2}$ of nMOSFET m2, which is equal to the gate-source voltage $V_{gs2}$ of nMOSFET m2 minus the threshold voltage $V_{t2}$ of nMOSFET m2. In other words, nMOSFET m2 enters the linear region when the following equation (3) holds:

$$V_{ds2}=V_{dsat2}=V_{gs2}-V_2 \quad (3)$$

Since the amplifier AMP has minimal offset, the voltage at the negative terminal of the amplifier (namely, $V_{dsl}$) is equal to the voltage at the positive terminal of the amplifier (namely, $V_{REF}$). Accordingly, the minimum output voltage $V_{OUTmin}$ is equal to the reference voltage $V_{REF}$ plus the saturation voltage $V_{dsat2}$ of the nMOSFET m2 according to the following equation (4):

$$V_{OUTmin}=V_{REF}+V_{dsat2} \quad (4)$$

Accordingly, since it is advantageous to minimize $V_{OUTmin}$, it is also advantageous to minimize $V_{REF}$. This can be done so long as $V_{REF}$ is greater than $V_{dsatl}$ ($V_{dsatl}=V_{gsl}-V_{tl}$). Any further reduction would push the nMOSFET ml into the linear region thereby degrading the current mirroring function.

Since $V_{dsatl}$ is process and temperature dependent, biasing nMOSFET ml so that $V_{dsl}$ exceeds $V_{dsatl}$ by a minimal amount can be challenging. Accordingly, what would be advantageous would be a circuit that allows for the proper biasing of nMOSFET ml to allow a small minimum output voltage with little additional circuitry to occupy additional chip space.

BRIEF SUMMARY OF THE INVENTION

The foregoing problems with the prior state of the art are overcome by the principles of the present invention, which are directed towards an enhanced output impedance current mirror that properly biases the transistor while using less additional circuitry than a standard enhanced output current mirror.

As in conventional enhanced output impedance current mirrors, the new enhanced output impedance current mirror includes an nMOSFET M1 having a source terminal that is connected to a low voltage source, and an nMOSFET M2 having a source terminal that is connected to a drain terminal of the first nMOSFET M1. The current is mirrored from a different part of circuit by applying appropriate biases to the gate terminal of nMOSFET M1 as is conventionally known. The output current is the current going into the source terminal of nMOSFET M2, and the output impedance is the impedance looking into the source terminal of nMOSFET M2.

A uniquely designed circuit is connected to nMOSFETs M1 and M2 so as to apply the appropriate biases to nMOSFET M1 such that the minimum output voltage may be only the sum of the saturation voltages of both of the nMOSFETs M1 and M2. The operational amplifier also provides the necessary gain to enhance output impedance thereby serving two roles with just a few additional components configured in a certain previously unknown way described hereinafter.

As in a conventional operational amplifier, the operational amplifier includes a current source (I) having a first terminal connected to a high voltage source. In this description and in the claims, one node in a circuit is "connected" to another node in the circuit if charge carriers freely flow (even through some devices) between the two nodes during normal operation of the circuit. A differential pair is then provided having gate terminals as input terminals to the operational amplifier. Specifically, one pMOSFET M3 has a gate terminal connected to the source terminal of the nMOSFET M2. A source terminal of the pMOSFET M3 is connected to a second terminal of the current source (I). A drain terminal of the pMOSFET M3 is connected to a gate terminal of the second nMOSFET (M2). Similarly a second pMOSFET (M4) has a source terminal connected to the second terminal of the current source (I).

Unlike conventional enhanced output impedance current mirrors, however, the operational amplifier includes four nMOSFETs M5-M8 having a common gate terminal that is connected to the drain of pMOSFET M4. By properly designing the length to width ratios as will be described further below, a desired reference voltage and drain-source voltage of transistor M1 may be obtained to thereby significantly reduce the lowest output voltage of the enhanced output impedance current mirror.

Another embodiment of the invention may be accomplished by substituting all nMOSFETs with pMOSFETs, and vice versa, and by tying any terminals that were connected to a lower voltage source to a high voltage source, and vice versa. Accordingly, an enhanced output impedance current mirror is obtained using minimal additional devices while allowing for a reduced minimum output voltage.

Additional features and advantages of the invention will be set forth in the description that follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Enhanced output impedance current mirrors are conventionally used to mirror current from one portion of a circuit to another, while increasing the output impedance associated with the output current. Reducing the minimum output voltage is desirable. In addition, reducing circuit complexity is desirable so long as the functioning of the circuit is not sacrificed. The principles of the present invention provide an enhanced output impedance current mirror in which very low output voltages are possible with few additional devices as compared to conventional enhanced output impedance current mirrors.

Figure 1:
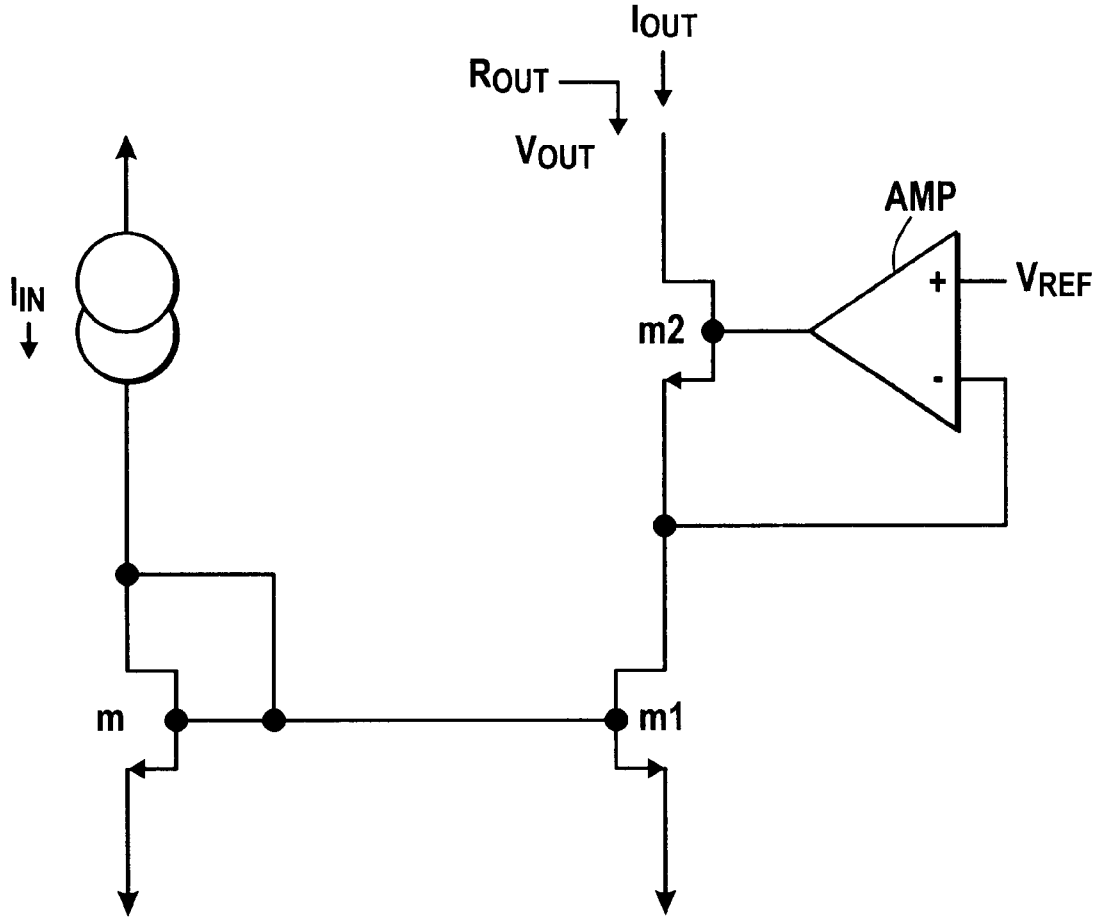
Fig. 1 (Prior Art)
FIG. 1 illustrates an enhanced output impedance current mirror in accordance with the prior art.
Figure 2:
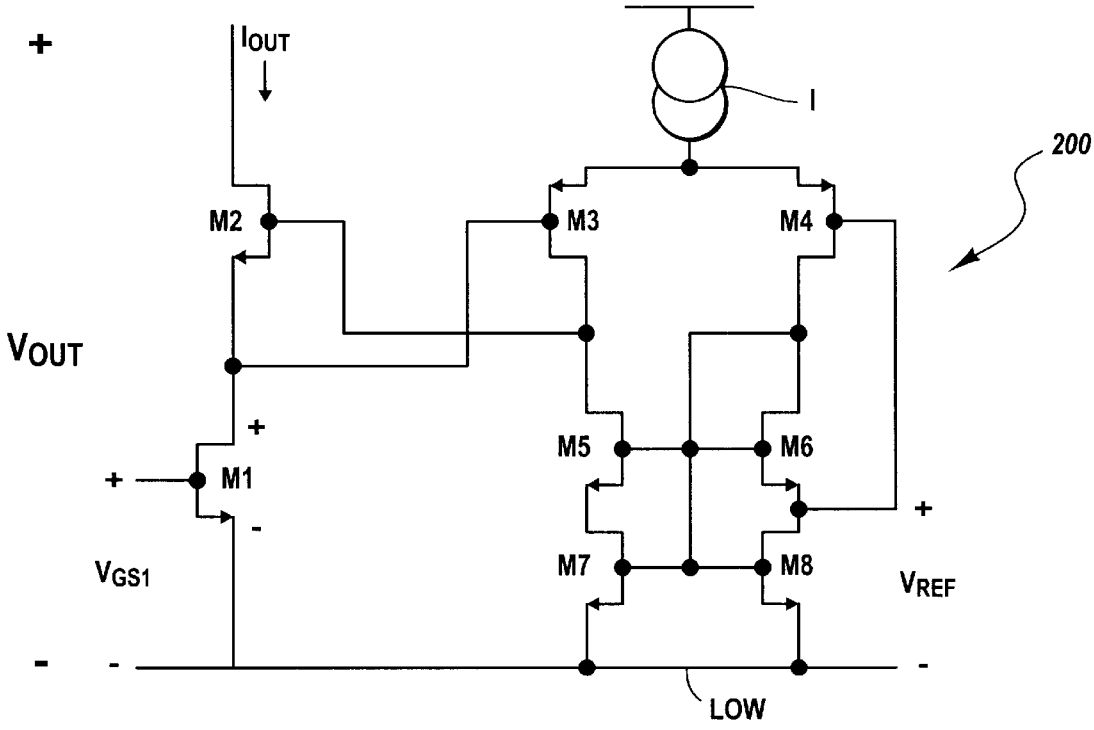
FIG. 2 illustrates an enhanced output impedance current mirror in accordance with a first embodiment of the present invention.

FIG. 2 illustrates an enhanced output impedance current mirror 200 in accordance with a first embodiment of the present invention. As in conventional enhanced output impedance current mirrors, the enhanced output impedance current mirror 200 includes an nMOSFET M1 having a source terminal that is connected to a low voltage source LOW, and an nMOSFET M2 having a source terminal that is connected to a drain terminal of the first nMOSFET M1. The current is mirrored from a different part of circuit by applying appropriate biases to the gate terminal of nMOSFET M1 as is conventionally known and as is illustrated in FIG. 1. The output current $I_{OUT}$ is the current going into the source terminal of nMOSFET M2, and the output impedance is the impedance looking into the source terminal of nMOSFET M2.

A uniquely designed operation amplifier (namely, the circuitry to the right of nMOSFETs M1 and M2) is connected to nMOSFETs M1 and M2 so as to apply the appropriate biases to nMOSFET M1 such that the minimum output voltage may be as low as the sum of the saturation voltages of both of the nMOSFETs M1 and M2. The operational amplifier also provides the necessary gain to enhance output impedance thereby serving two roles with just a few additional devices configured in a certain previously unknown way.

As in a conventional operational amplifier, the operational amplifier includes a current source (I) having a first terminal connected to a high voltage source. A differential pair is then provided having gate terminals as input terminals to the operational amplifier. Specifically, one pMOSFET M3 has a gate terminal connected to the source terminal of the nMOSFET M2. A source terminal of the pMOSFET M3 is connected to a second terminal of the current source (I). A drain terminal of the pMOSFET M3 is connected to a gate terminal of the second nMOSFET M2. Similarly, a second pMOSFET M4 has a source terminal connected to the second terminal of the current source (I).

Unlike conventional enhanced output impedance current mirrors, however, the operational amplifier includes four nMOSFETs M5-M8 having a common gate terminal that is connected to the drain of pMOSFET M4. More specifically, nMOSFET M5 has a gate terminal connected to a drain terminal of pMOSFET M4, and has a drain terminal connected to the drain terminal of pMOSFET M3. nMOSFET M6 has a gate terminal connected to the gate terminal of nMOSFET M5, has a drain terminal connected to the drain terminal of pMOSFET M4, and has a source terminal connected to a gate terminal of the second pMOSFET M4. nMOSFET M7 has a gate terminal connect to the gate terminal of nMOSFET M5, has a drain terminal connected to the source terminal of the nMOSFET M5, and has a source terminal connected to the low voltage source. nMOSFET M8 has a gate terminal connected to the gate terminal of nMOSFET M5, has a drain terminal connected to the source terminal of nMOSFET M6, and has a source terminal connected to the low voltage source LOW.

In this configuration, the reference voltage $V_{REF}$ would be defined by the following equation (5):

$$V_{REF} = \sqrt{\frac{I}{\beta_6}}\left(\sqrt{\frac{\beta_6+\beta_8}{\beta_6\beta_8}} - 1\right) \quad (5)$$

where $\beta_6$ is the channel length-to-width ratio of the nMOSFET M6, and $\beta_8$ is the channel length-to-width ratio of the nMOSFET M8.

The channel length-to-width ratios are parameters that may be chosen by the circuit designer. Accordingly, the reference voltage $V_{REF}$ may be chosen to be a minimal value above the saturation voltage ($V_{dsatl}$) of the nMOSFET M1. A typical minimal value might be for example, 100 millivolts above the saturation voltage. In a broader embodiment of the present invention, the minimal value may be any voltage greater than or equal to the saturation voltage. In yet another embodiment, the reference voltage $V_{REF}$ is somewhat below the saturation voltage ($V_{dsatl}$) of the nMOSFET M1. In that case, the performance of the current mirror would be somewhat degraded but may still be better than the conventional enhanced output impedance current mirror. If the reference voltage were chosen to be exactly $V_{dsatl}$, then the lowest possible output voltage would be just the sum of the saturation voltages of the two nMOSFETs M1 and M2.

Furthermore, since process and temperature variations that apply to nMOSFET M1 would also tend to apply to nMOSFETs M5 through M8 through device matching, the voltage $V_{REF}$ would tend to increase and decrease more proportionally with $V_{dsatl}$ with temperature and process variations, thereby reducing the impact of such process and temperature variations.

Figure 3:
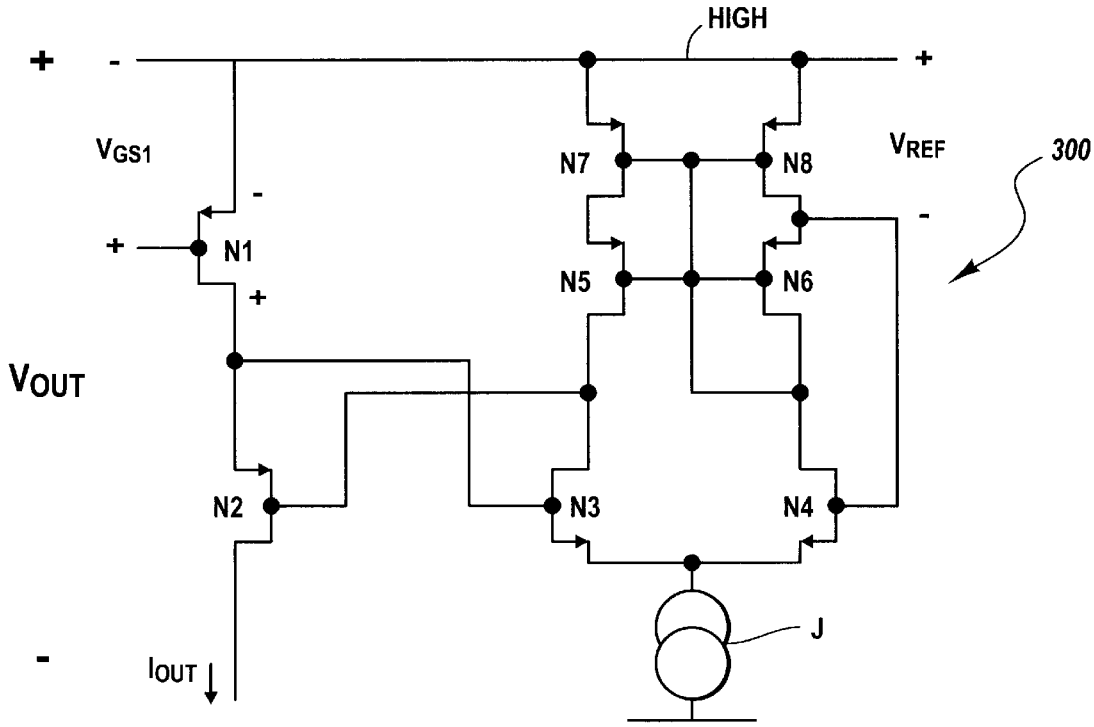
FIG. 3 illustrates an enhanced output impedance current mirror in accordance with a second embodiment of the present invention.

Another embodiment of the invention may be accomplished by substituting all nMOSFETs with pMOSFETs, and vice versa, and by tying any terminals that were connected to a lower voltage source to a high voltage source, and vice versa. FIG. 3 illustrates such an embodiment in which pMOSFETs N1 through N8 are similar to MOSFETs M1 through M8, except that p-type MOSFETS are switched for n-type MOSFETS, and visa versa. Furthermore, current source J is connected to a low voltage supply instead of current source I being connected to a high voltage source. Also, MOSFETs N1, N7 and N8 are connected to high voltage source HIGH, instead of MOSFETs M1, M7 and M8 being connected to low voltage source LOW.

Figure 4:
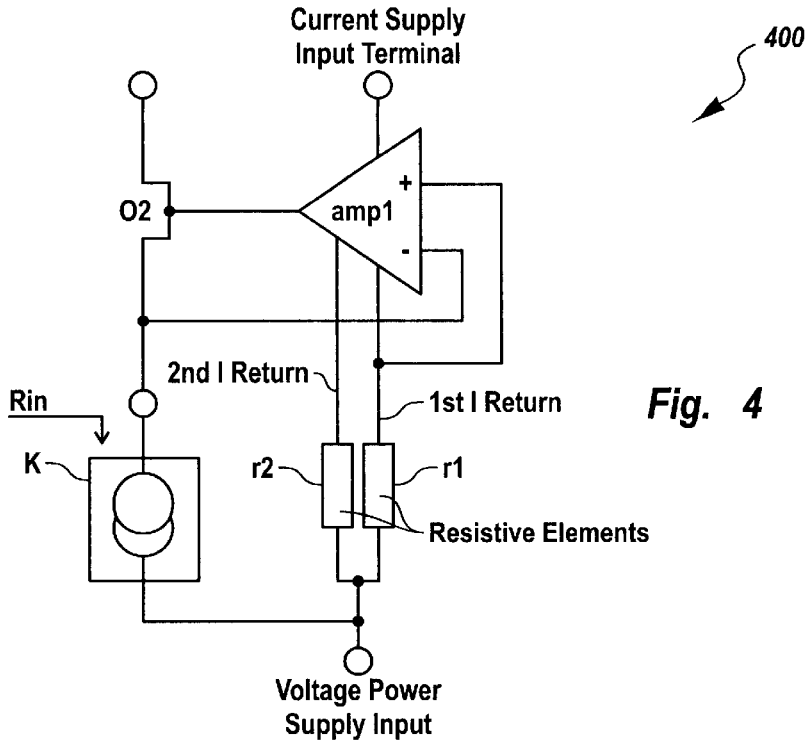
FIG. 4 illustrates an enhanced output impedance current mirror in accordance with a third embodiment of the present invention.

Additional embodiments of an enhanced output impedance current mirror will become apparent to those of ordinary skill in the art after having reviewed this description. For example, FIG. 4 illustrates an enhanced output impedance current mirror 400 that is similar to the enhanced output impedance current mirror 200 of FIG. 2 and the enhanced output impedance current mirror 300 of FIG. 3 except for the following characteristics. The ampl is a general amplifier that replaces the specific amplifier configuration of FIG. 2 that includes transistors M3, M4, M5 and M6 (or the specific amplifier configuration of FIG. 3 that includes transistors N3, N4, N5 and N6). In addition, resistive elements r1 and r2 replace the transistors M7 and M8 of FIG. 2 (or the transistors N7 and N8 of FIG. 3) in respective current return paths. Furthermore, the current source K replaces the transistor M1 of FIG. 2 (or the transistor N1 of FIG. 3). The terminal of the current source that is connected to the transistor O2 will be also be referred to herein as the "first current electrode" of the transistor O2. The terminal on the other side of the channel region of the transistor O2 will also be referred to as the "second current electrode" of the transistor O2.

The current mirror operates to effectively increase output impedance Rin when one of the resistive elements is properly sized so that the voltage drop across the resistor, when summed with the offset voltage between inverting terminal and the non-inverting terminal of the amplifier ampl, provides a voltage the current source K such that the current source K provides a predictable current.

Figure 5:
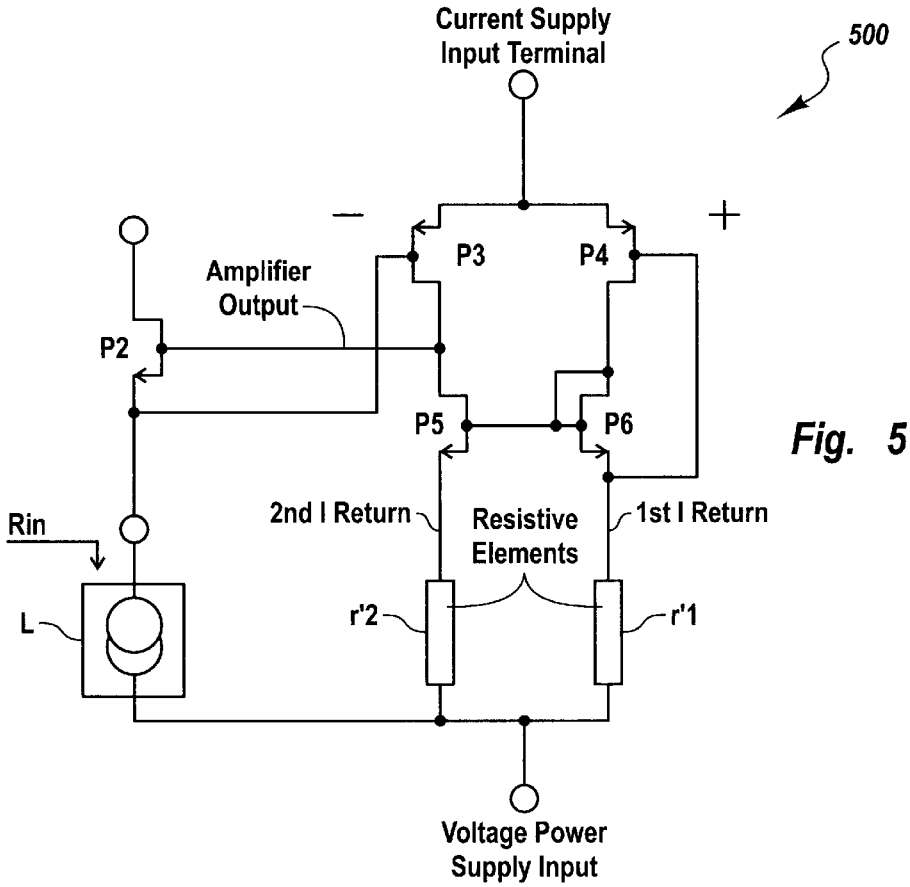
FIG. 5 illustrates an enhanced output impedance current mirror in accordance with a fourth embodiment of the present invention.

FIG. 5 illustrates an enhanced output impedance current mirror 500 that is similar to the enhanced output impedance current mirror 400 of FIG. 4, except that a specific amplifier configured comprising transistors P3, P4, P5, P6 is used to perform amplification similar to how amplification was performed using transistors M3, M4, M5 and M6 of FIG. 2. In addition, NMOS transistor P2 replaces transistor O2, which could have been an NMOS or PMOS transistor. Current Source L of FIG. 5 may be similar to current source K of FIG. 4, and resistive elements r'1 and r'2 of FIG. 5 may be similar to resistive elements r1 and r2 of FIG. 4.

Figure 6:
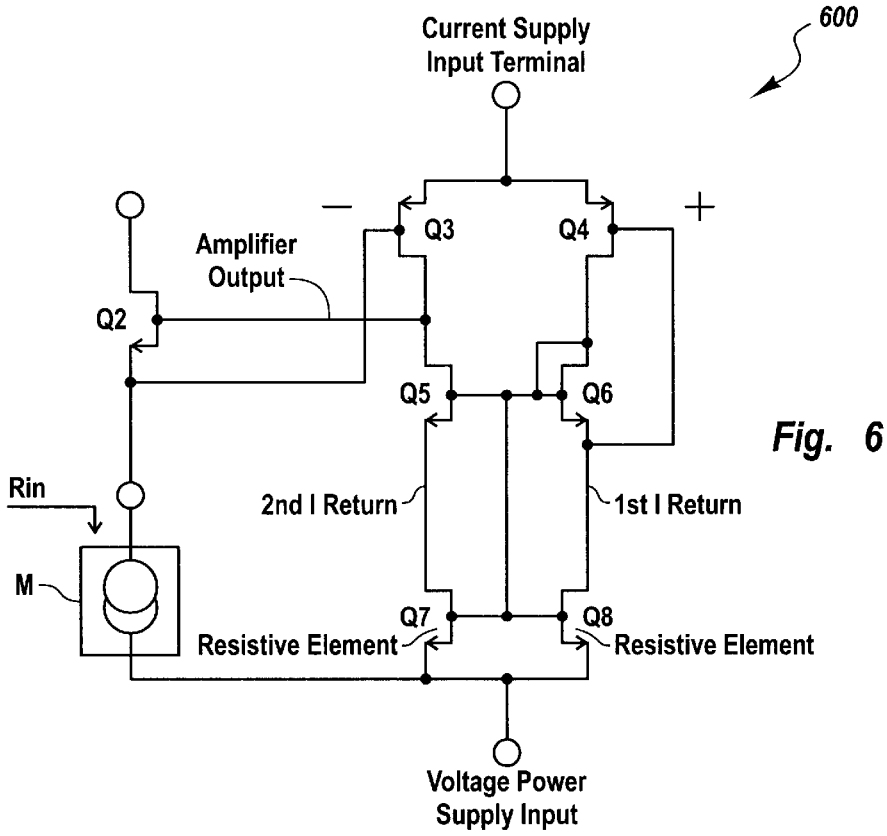
FIG. 6 illustrates an enhanced output impedance current mirror in accordance with a fifth embodiment of the present invention.

FIG. 6 illustrates an enhanced output impedance current mirror 600 that is similar to the enhanced output impedance current mirror 500 of FIG. 5, except that transistors Q7 and Q8 replace resistive element r'1 and r'2. Transistors Q3, Q4, Q5, Q6, Q7 and Q8 may be similar to the transistors M3, M4, M5, M6, M7 and M8, respectively, of FIG. 2. Also, current source M may be similar to the current source L of FIG. 5.

Figure 7:
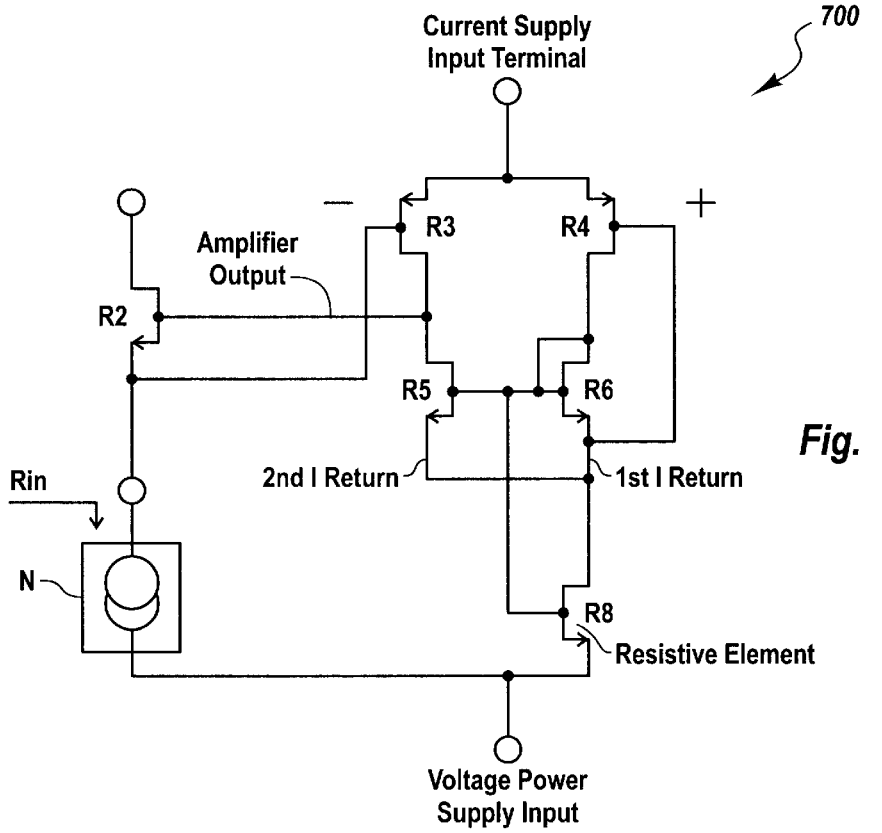
FIG. 7 illustrates an enhanced output impedance current mirror in accordance with a sixth embodiment of the present invention.

FIG. 7 illustrates an enhanced output impedance current mirror 700 that is similar to the enhanced output impedance current mirror 600 of FIG. 6, except that the sources of transistors R5 and R6 are both tied to the drain of transistor R8, and transistor R7 is absent. Transistors R2, R3, R4, R5 and R6 may be similar to the transistors M2, M3, M4, M5 and M6 of FIG. 2. Also, current source N may be similar to the current source M of FIG. 6.

Figure 8:
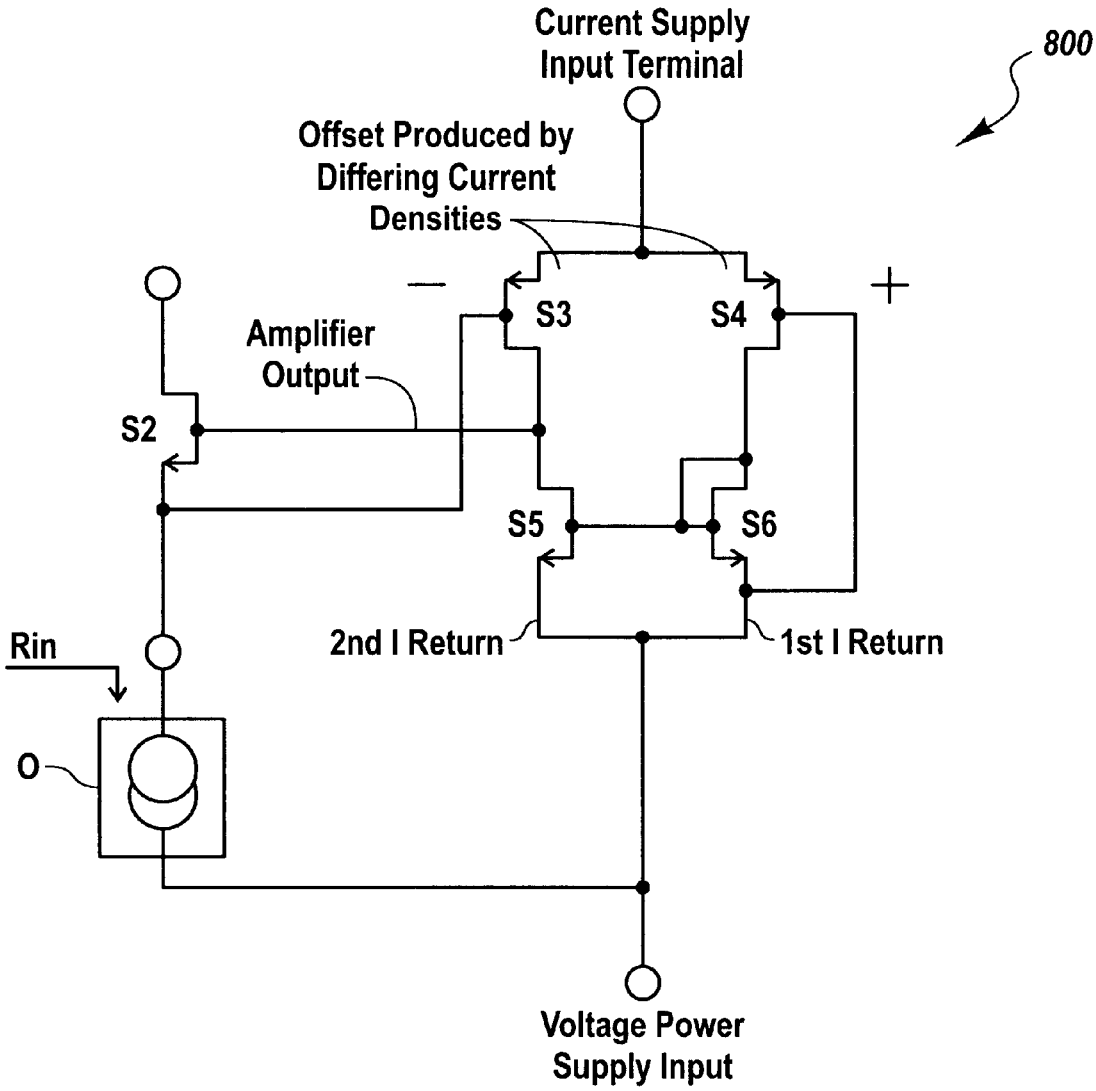
FIG. 8 illustrates an enhanced output impedance current mirror in accordance with a seventh embodiment of the present invention.

FIG. 8 illustrates an enhanced output impedance current mirror 800 that is similar to the enhanced output impedance current mirror 700 of FIG. 7, except that the there is no resistance in the return current paths. Instead, the voltage across the current source O is maintained by an intentional offset voltage imposed by passing different current densities through the resistors S3 and S4. Transistors S2, S3, S4, S5 and S6 may be similar to the transistors M2, M3, M4, M5 and M6 of FIG. 2. Also, current source O may be similar to the current source N of FIG. 7.

Accordingly, an enhanced output impedance current mirror is obtained using minimal additional devices while allowing for a reduced minimum output voltage. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes, which come within the meaning and range of equivalency of the claims, are to be embraced within their scope.

What is claimed and desired secured by United States Letters Patent is:

1. An enhanced output impedance current mirror comprising the following:

a current source (I) having a first terminal connected to a high voltage source;

a first nMOSFET(M1) having a source terminal that is connected to a low voltage source;

a second nMOSFET (M2) having a source terminal that is connected to a drain terminal of the first nMOSFET(M1);

a first pMOSFET (M3) having a gate terminal connected to the source terminal of the second nMOSFET (M2), having a source terminal connected to a second terminal of the current source (I), and having a drain terminal that is connected to a gate terminal of the second nMOSFET (M2);

a second pMOSFET (M4) having a source terminal connected to the second terminal of the current source (I);

a third nMOSFET (M5) having a gate terminal connected to a drain terminal of the second pMOSFET (M4), and having a drain terminal connected to the drain terminal of the first pMOSFET (M3);

a fourth nMOSFET (M6) having a gate terminal connected to the gate terminal of the third nMOSFET (M5), having a drain terminal connected to the drain terminal of the second pMOSFET (M4), and having a source terminal connected to a gate terminal of the second pMOSFET (M4);

a fifth nMOSFET (M7) having a gate terminal connect to the gate terminal of the third nMOSFET (M5), having a drain terminal connected to the source terminal of the third nMOSFET (M5), and having a source terminal connected to the low voltage source; and a sixth nMOSFET (M8) having a gate terminal connected to the gate terminal of the third nMOSFET (M5), having a drain terminal connected to the source terminal of the fourth nMOSFET (M6), and having a source terminal connected to the low voltage source.

2. An enhanced output impedance current mirror in accordance with claim 1, wherein the length-to-width ratios of the fourth nMOSFET (M6) and the sixth nMOSFET (M8) are structured such that the voltage at the gate terminal of the second pMOSFET (M4) is greater than or equal to a saturation voltage of the first nMOSFET (M1).

3. An enhanced output impedance current mirror in accordance with claim 1, wherein the length-to-width ratios of the fourth nMOSFET (M6) and the sixth nMOSFET (M8) are structured such that the voltage at the gate terminal of the second pMOSFET (M4) is approximately 100 millivolts greater than a saturation voltage of the first nMOSFET (M1).

4. An enhanced output impedance current mirror comprising the following:

a current source (J) having a first terminal connected to a low voltage source;

a first pMOSFET (N1) having a source terminal that is connected to a high voltage source;

a second pMOSFET (N2) having a source terminal that is connected to a drain terminal of the first pMOSFET (N1);

a first nMOSFET (N3) having a gate terminal connected to the source terminal of the second pMOSFET (N2), having a source terminal connected to a second terminal of the current source (J), and having a drain terminal that is connected to a gate terminal of the second pMOSFET (N2);

a second nMOSFET (N4) having a source terminal connected to the second terminal of the current source (J);

a third pMOSFET (N5) having a gate terminal connected to a drain terminal of the second nMOSFET (N4), and having a drain terminal connected to the drain terminal of the first nMOSFET (N3);

a fourth pMOSFET (N6) having a gate terminal connected to the gate terminal of the third pMOSFET (N5), having a drain terminal connected to the drain terminal of the second nMOSFET (N4), and having a source terminal connected to a gate terminal of the second nMOSFET (N4);

a fifth pMOSFET (N7) having a gate terminal connect to the gate terminal of the third pMOSFET (N5), having a drain terminal connected to the source terminal of the third pMOSFET (N5), and having a source terminal connected to the low voltage source; and a sixth pMOSFET (N8) having a gate terminal connected to the gate terminal of the third pMOSFET (N5), having a drain terminal connected to the source terminal of the fourth pMOSFET (N6), and having a source terminal connected to the low voltage source.

5. An enhanced output impedance current mirror in accordance with claim 4, wherein the length-to-width ratios of the fourth pMOSFET (N6) and the sixth pMOSFET (N8) are structured such that the voltage at the gate terminal of the second pMOSFET (N4) is greater than or equal to a saturation voltage of the first pMOSFET (N1).

6. An enhanced output impedance current mirror in accordance with claim 4, wherein the length-to-width ratios of the fourth pMOSFET (N6) and the sixth pMOSFET (N8) are structured such that the voltage at the gate terminal of the second pMOSFET (N4) is approximately 100 millivolts greater than a saturation voltage of the first pMOSFET (N1).

7. A circuit placed in series with a current source to increase the current source's output impedance comprising:

a first transistor (O2) having a first current electrode coupled to the current source (K) whose impedance is to be increased, and a second current electrode for providing the output current, and a control electrode for receiving a controlling voltage;

an amplifier (amp1) having an inverting terminal coupled to the first current electrode of the first transistor (O2), an output terminal coupled to the control electrode of the first transistor (O2), a bias current input, a first current return path, a second current return path, and a non-inverting terminal coupled to the first current return path;

a first resistive element (r1) having a first terminal coupled to the first current return path of AMP, and a second terminal coupled to a power supply voltage terminal; and a second resistive element (r2) having a first terminal coupled to the second current return path of amplifier (amp1), and a second terminal coupled to a power supply voltage terminal.

8. The circuit as recited in claim 7, wherein the first resistive element is sized so that its voltage drop when summed with the voltage between the inverting terminal and the non-inverting terminal of amplifier AMP provides a voltage that will bias a current source so that said current source will provide a predictable current.

9. The circuit as recited in claim 8, wherein the first transistor is an nMOSFET, at and the amplifier is comprised of:

a first pMOSFET (P4) with a gate coupled to the non-inverting terminal of the amplifier, a source coupled to bias current input of the amplifier, and a drain coupled to the drain of a first nMOSFET (P6);

a second pMOSFET (P3) with a gate coupled to the inverting terminal of the amplifier, a source coupled to the bias current input of the amplifier, and a drain coupled to the output of the amplifier;

a first nMOSFET (P6) having a source coupled to the first current return terminal of the amplifier, and a gate coupled to the drain of pMOSFET (P4); and a second nMOSFET (P5) having a source coupled to the second current return terminal of the amplifier, a gate terminal coupled to the gate terminal of nMOSFET (P6), and a drain terminal coupled to the output of the amplifier.

10. The circuit as recited in claim 9, wherein:

the first resistive element is a first nMOSFET (Q8) having a source coupled to a power supply voltage terminal, a drain coupled to the first current return terminal of the amplifier, and a gate coupled to the gate of first nMOSFET; and the second resistive element is a second nMOSFET (Q7) having a source coupled to a power supply voltage terminal, a drain coupled to the second current return terminal of the amplifier, and a gate coupled to the gate of the second nMOSFET M5.

11. The circuit as recited in claim 9, wherein:

the first resistive element is a first nMOSFET (R8) having a source coupled to a power supply voltage terminal, a drain coupled to the first current return terminal of the amplifier, and a gate coupled to the gate of nMOSFET M6; and the second current return terminal of the amplifier is connected to the first current return terminal of the amplifier.

12. The circuit in claim 9, wherein the first and second pMOSFETs are biased at different current densities to produce a predictable voltage differential between the inverting and non-inverting terminals of the amplifier.

13. The circuit in claim 12 wherein the first and second resistive elements are substantially zero, and the necessary bias for the current source is generated entirely by the amplifier offset caused by the pMOSFETs M3 and M4 operating at differing current densities.

* * * * *

UNITED STATES PATENT AND TRADEMARK OFFICE

CERTIFICATE OF CORRECTION

PATENT NO. : 6,707,286 B1 
DATED : March 16, 2004
INVENTOR(S) : Bernard Robert Gregoire, Jr.

It is certified that error appears in the above-identified patent and that said Letters Patent is hereby corrected as shown below:

Title page,
Item [56], References Cited, OTHER PUBLICATIONS, "A High-Swing," reference, after "1990" insert -- pp. 289 to 298 --

Column 1,
Line 63, change "$V_2$" to -- $V_{t2}$ --

Column 2,
Line 34, after "of" insert -- the --

Column 4,
Line 18, after "of" insert -- the --
Line 58, change "connect" to -- connected --

Column 5,
Line 61, after "will" delete "be"

Column 6,
Line 4, after "voltage" insert -- to --
Line 20, change "element" to -- elements --
Line 54, after "desired" insert -- to be --

Column 8,
Line 47, after "nMOSFET" delete "at"

Signed and Sealed this

Twenty-eighth Day of September, 2004

JON W. DUDAS
*Director of the United States Patent and Trademark Office*